United States Patent [19]

Murray

[11] 4,136,847

[45] Jan. 30, 1979

[54] WINDOW SHADE AND CURTAIN ROD BRACKET PLATE

[76] Inventor: Carl F. Murray, 3140 Mohican Ave., Dayton, Ohio 45429

[21] Appl. No.: 895,544

[22] Filed: Apr. 12, 1978

[51] Int. Cl.[2] ..... A47H 1/142

[52] U.S. Cl. ..... 248/256; 248/265; 248/269

[58] Field of Search ..... 248/251, 257, 258, 265, 248/263, 256, 266, 269, 263, 270, 252, 254, 255

[56] References Cited

U.S. PATENT DOCUMENTS

| | | | |
|---|---|---|---|
| 1,190,007 | 7/1916 | Rayder | 248/258 |
| 1,657,017 | 1/1928 | Lamberson | 248/256 |
| 2,144,242 | 1/1939 | Gill | 248/263 |
| 2,309,725 | 2/1943 | Yerton | 248/263 |
| 2,809,798 | 10/1957 | Kenny | 248/263 |
| 2,937,838 | 5/1960 | Kelvington | 248/265 |
| 2,974,918 | 3/1961 | Voigtlander | 248/256 X |
| 3,430,908 | 3/1969 | Kowalczyk | 248/258 X |

*Primary Examiner*—J. Franklin Foss

[57] ABSTRACT

A pair of metal plates, for being mounted either on a wall or opposite sides of a window frame, each metal plate including a tongue struck out from a center thereof, and bent at right angle, so as to support a window shade therebetween, in order to extend across a window, each metal plate being sidewardly adjustable by having longitudinal slots through which mounting screws are fitted, and each metal plate also including a "U"-shaped bent portion that is forwardly raised, and includes mounting holes for supporting either a double curtain rod bracket, a single curtain rod bracket, a large cafe rod bracket or for a traverse rod bracket.

1 Claim, 5 Drawing Figures

WINDOW SHADE AND CURTAIN ROD BRACKET PLATE

This invention relates generally to upholstery hardware.

A principal object of the present invention is to provide a window shade and curtain rod bracket plate, which is mounted in pairs on opposite sides of a window frame or wall, in order to support therefrom a window shade, as well as either double curtains, single curtains, and the like.

Another object of the present invention is to provide a window shade and curtain rod bracket plate, which quickly and readily allows the placement of window shades and curtain rods in relation to one another.

Yet another object of the present invention is to provide a window shade and curtain rod bracket plate, which allows adjustability of the window shade position, so that it can be either closer or farther away from the window, as preferred.

Yet a further object is to provide a window shade and curtain rod bracket plate, which is slidably adjustable on mounting screws secured in a wall or window frame, in order that the same may be fine adjusted.

Other objects are to provide a window shade and curtain rod bracket plate, which is simple in design, inexpensive to manufacture, rugged in construction, easy to use and efficient in operation.

These, and other objects, will be readily evident, upon a study of the following specification, and the accompanying drawing, wherein.

Figure 1:
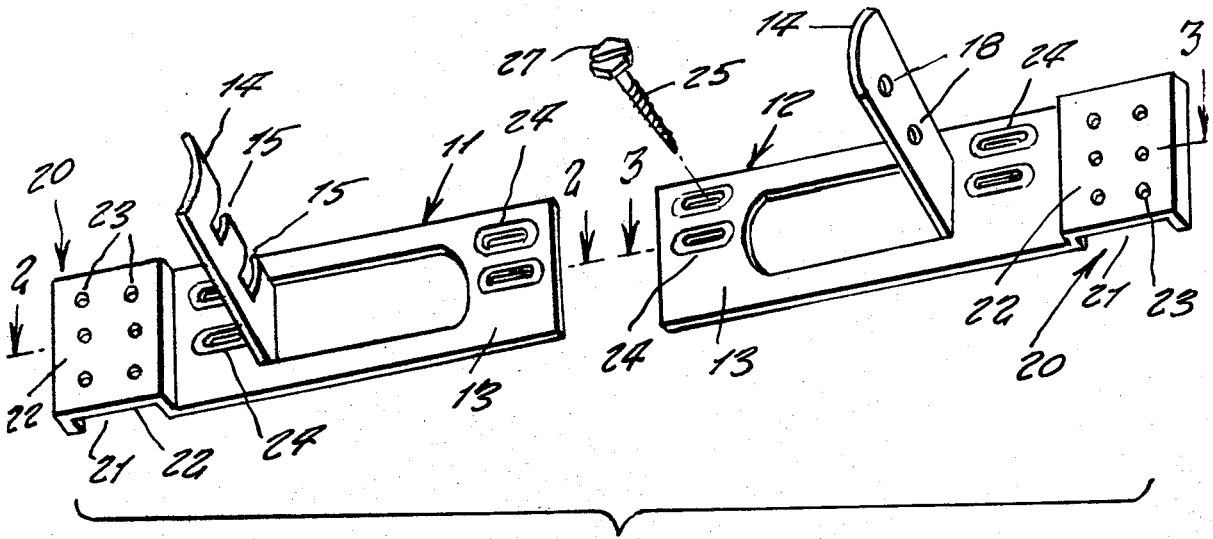
FIG. 1 is a perspective view of a pair of bracket units that comprise, together, the present invention.
Figure 2:
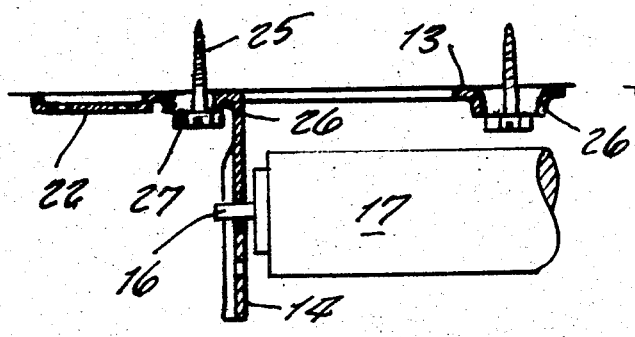
FIG. 2 is a cross-sectional view, taken on line 2—2 of FIG. 1.
Figure 3:
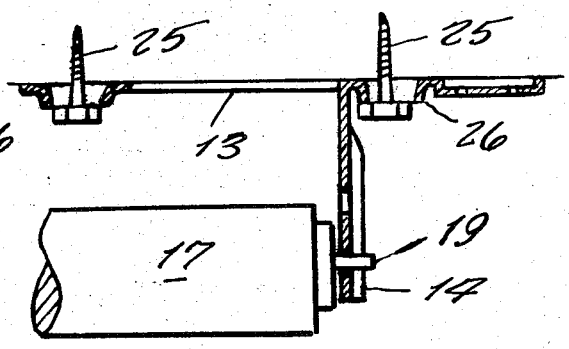
FIG. 3 is a cross-sectional view, taken on line 3—3 of FIG. 1.
Figure 4:
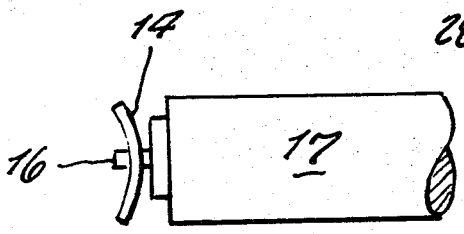
FIG. 4 is a fragmentary front elevation view of the structure shown in FIG. 2.

Referring now to the drawing in greater detail, and more particularly to FIGS. 1 through 4 at this time, the reference numeral 10 represents the present invention wherein there are a pair of bracket units 11 and 12, that are made nearly a same, except that each is made in order to support dissimilar opposite ends of a window shade, and the bracket units 11 and 12 being made so that one is used on a left side of a window, and the other is on a right side thereof.

Each of the bracket units 11 and 12 is made from a flat metal plate 13, of a suitable thickness in order to be stiff; each metal plate having a tongue 14 struck out from a center thereof, and being bent up at right angle thereto. Each of the tongues tapers towards its outward end in an arcuate shape, as clearly shown in FIG. 1. The tongue 14, of the bracket unit 11, is provided with a pair of spaced-apart notches 15, in order to selectively receive a flat blade 16, which protrudes outwardly of one end of a window shade 17. The tongue of the other bracket unit 12 is provided with a pair of spaced-apart openings 18, in order to receive a pin 19, that protrudes outward of an opposite end of the window shade 17.

One end of each metal plate, which is closest to the bent-up tongue, is bent up into a "U"-shaped configuration, as shown at 20, so as to form a recess 21, behind a forwardly raised portion 22. The forwardly raised portion is provided with two vertical rows of openings 23, there being three of such openings in each of the rows. These openings are provided for mounting of either a double curtain rod bracket, a single curtain rod bracket, a large cafe rod bracket or a traverse rod bracket.

The remaining flat portion of metal plate 13 includes a pair of slots 24, near each opposite end thereof, each of the slots being adaptable for receiving a mounting screw 25, that is secured either into a wall or window frame. As clearly shown in FIGS. 2 and 3, each of the slots has a forwardly extending raised lip 26, and the underside of screw head 27 bears thereagainst.

In operative use, it is now evident that, when the bracket units are mounted, by means of screws 25, to a wall or window frame, the bracket units can be readily adjusted closer or further apart, by means of the slots 24, before the screws 25 are screwed down hard. A window shade can be supported in either of the slots 15 and openings 18 of the tongues, so that the window shade can be made either further or closer from the window. The "U"-shaped portions provide a means for support of either double curtain rod brackets, single curtain rod brackets, large cafe rod brackets or traverse rod brackets.

Figure 5:
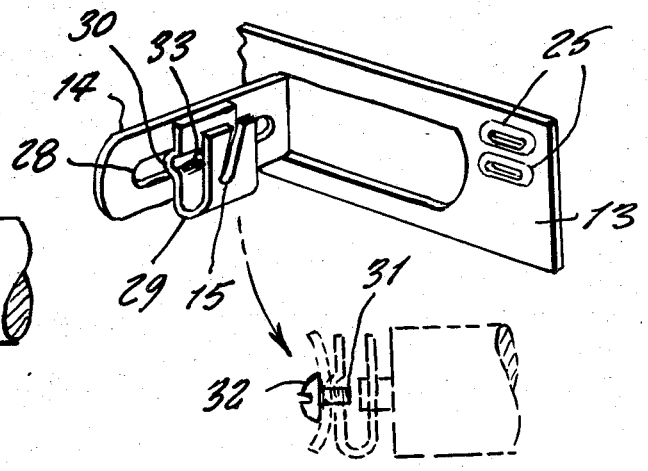
FIG. 5 is a perspective view of a modified design of the invention, in which a more precise adjustment of a window shade is made possible.

Referring now to FIG. 5, there is shown a slightly modified design of the invention, wherein the above described tongue 14 is provided with a slot 28 along which a secondary bracket 29 is slidable, due to a sidewardly bent portion 30 on the secondary bracket fitting into the slot 28. The secondary bracket 29 is relatively narrow, and includes either a single one of the shade slots 15, or else a single one of the above described openings 18. A screw 31 is fitted into the slot 28, so that a screw head 32 bears against one side of the tongue 14. The screw engages a threaded opening 33, made in a center of the bent portion 30 of secondary bracket 29. Thus, the screw rigidly affixed the secondary bracket along any position of the tongue.

While various changes may be made in the detail construction, it is understood that such changes will be within the spirit and scope of the present invention, as is defined by the appended claims.

What I now claim is:

1. A window shade and curtain rod bracket plate assembly, comprising, in combination, a pair of right and left hand bracket units, each of which comprises a metal plate having a tongue struck out from a center thereof, and bent at right angles thereto, each of said tongues having support means for supporting a window shade either closer or further from a window, and means at one end of said metal plate for selectively supporting either a double curtain rod bracket, a single curtain rod bracket, a large cafe rod bracket or a traverse rod bracket; and said tongue supports a secondary bracket which carries said support means for said window shade, said tongue having a longitudinally extending slot therein, said secondary bracket is "U"-shaped with one leg thereof having a transverse, offset bend thereacross for sliding in said slot, and rigid securement means of said secondary bracket to said tongue in a selected slided position.

* * * * *